US011312556B2

(12) United States Patent
Han et al.

(10) Patent No.: US 11,312,556 B2
(45) Date of Patent: Apr. 26, 2022

(54) FALSE EYELASH PACKAGING

(71) Applicant: Kiss Nail Products, Inc., Port Washington, NY (US)

(72) Inventors: Kyu Sang Han, Port Washington, NY (US); Siyong Sung, Roslyn Heights, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 776 days.

(21) Appl. No.: 14/645,920

(22) Filed: Mar. 12, 2015

(65) Prior Publication Data

US 2016/0264334 A1 Sep. 15, 2016

(51) Int. Cl.
*B65D 77/30* (2006.01)
*B65D 73/00* (2006.01)

(52) U.S. Cl.
CPC ..... *B65D 77/30* (2013.01); *B65D 73/0028* (2013.01)

(58) Field of Classification Search
CPC ..... B45D 73/0028; B45D 77/00; B45D 77/0007; A41G 5/02; B65D 77/30; B65D 83/00
USPC ..... 206/559, 460, 813; 132/216, 217
See application file for complete search history.

(56) References Cited

U.S. PATENT DOCUMENTS 2,974,229 A * 3/1961 Schmidt ..... G03C 3/003 378/169
3,947,313 A * 3/1976 Lichtwardt ..... B65C 11/00 156/767
4,742,913 A * 5/1988 Emmel ..... A47L 25/005 206/447
6,142,306 A * 11/2000 Mori ..... H05K 13/003 206/460
7,147,880 B2 * 12/2006 Lenahan ..... B65D 77/245 426/115
7,597,197 B2 * 10/2009 Lee ..... B65D 83/08 206/470
8,424,542 B1 * 4/2013 Han ..... A45C 11/00 132/212

FOREIGN PATENT DOCUMENTS

GB 1519222 * 7/1978

* cited by examiner

*Primary Examiner* — Anthony D Stashick
*Assistant Examiner* — Blaine G Neway

(57) ABSTRACT

The present disclosure is directed to a packaging for at least one false eyelash. In one embodiment, the packaging for the at least one false eyelash comprises a tray comprising one or more openings and at least one adhesive tab comprising an adhesive side coupled to a bottom side of the tray, wherein the adhesive side sticks to the at least one false eyelash via the one or more openings in the tray, wherein the at least one adhesive tab comprises a non-adhesive member that is used to pull the adhesive side away from the bottom side of the tray to release the at least one false eyelash from the tray.

9 Claims, 3 Drawing Sheets

FALSE EYELASH PACKAGING

BACKGROUND

False eyelashes are very delicate. Contact with the false eyelashes should be minimized to maintain the quality, appearance and integrity of the false eyelashes. Currently used packaging for false eyelashes requires a user to handle or touch the false eyelashes when they are removed from the packaging.

SUMMARY

In one embodiment, the present disclosure provides a packaging for at least one false eyelash. In one embodiment, the packaging for the at least one false eyelash comprises a tray comprising one or more openings and at least one adhesive tab comprising an adhesive side coupled to a bottom side of the tray, wherein the adhesive side sticks to the at least one false eyelash via the one or more openings in the tray, wherein the at least one adhesive tab comprises a non-adhesive member that is used to pull the adhesive side away from the bottom side of the tray to release the at least one false eyelash from the tray.

In another embodiment, the packaging for false eyelashes comprises a tray, comprising one or more openings and a slotted opening corresponding to the one or more openings and at least one adhesive tab comprising an adhesive side coupled to a bottom side of the tray, wherein the adhesive side sticks to the at least one false eyelash via the one or more openings in the tray, wherein the at least one adhesive tab comprises a non-adhesive member that is fitted through the slotted opening that is used to pull the adhesive side away from the bottom side of the tray to release the at least one false eyelash from the tray.

In one embodiment, the present disclosure provides a method for removing at least one false eyelash from a packaging. The method comprises holding a tray for the at least one false eyelash with the at least one false eyelash facing up, wherein the at least one false eyelash is secured to the tray from a bottom side of the tray via an adhesive side of an adhesive tab via one or more openings in the tray and pulling a non-adhesive member of the adhesive tab to pull the adhesive side away from the bottom side of the tray to release the at least one false eyelash, while maintaining the at least one false eyelash in the tray without touching the at least one false eyelash during the pulling of the non-adhesive member.

BRIEF DESCRIPTION OF THE DRAWINGS

So that the manner in which the above recited features of the present disclosure can be understood in detail, a more particular description of the disclosure, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

As discussed above, false eyelashes are very delicate. Contact with the false eyelashes should be minimized to maintain the quality, appearance and integrity of the false eyelashes. Currently used packaging for false eyelashes requires a user to handle or touch the false eyelashes when they are removed from the packaging.

Embodiments of the present disclosure provide a false eyelash packaging and method for removing the false eyelashes from the packaging without touching, handling or catching the false eyelashes when removing an adhesive tab from a tray holding the false eyelashes. In one embodiment of the present disclosure, the adhesive tab may be removed while a top side of the tray holding the false eyelashes continuously faces a user. In other words, the user is not required to turn the tray upside down to see the adhesive tab and catch the false eyelashes as they fall away from the tray while removing the adhesive tab as in other packaging methods.

As a result, the packaging requires no handling or touching of the false eyelashes until the false eyelashes are ready to be applied on the user. This allows for minimal handling of the false eyelashes, thereby, reducing the possibility that the false eyelashes are damaged during removal from the packaging.

Figure 1:
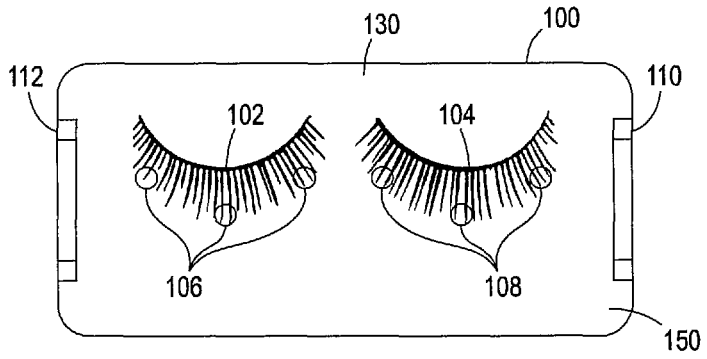
FIG. 1 depicts a top view of an example of a first embodiment of a false eyelash packaging.

FIG. 1 illustrates a top view of a first embodiment of a false eyelash packaging 100. In one embodiment, the false eyelash packaging 100 includes a tray 150. Although the tray 150 is illustrated as having a generally rectangular shape, it should be noted that the tray 150 may be formed into any shape (e.g., a square, a circle, any polygon, a non-uniform or non-geometric shape, and the like). In one embodiment, the tray 150 may be fabricated from a plastic.

In one embodiment, the tray 150 may have varying dimensions based upon a size of false eyelashes 102 and 104. For example, the tray 150 may have dimensions (e.g., a length and a width) large enough to fit the false eyelashes 102 and 104. It should be noted that although two false eyelashes 102 and 104 are illustrated in FIG. 1 that tray 150 may be designed to hold any number of false eyelashes (e.g., one or more).

In one embodiment, the tray 150 may have one or more holes 106 and 108. In one embodiment, the one or more holes 106 may correspond to the false eyelashes 102 and the one or more holes 108 may correspond to the false eyelashes 104. In one embodiment, the one or more holes 106 and 108 may have a generally circular shape. In another embodiment, the one or more holes 106 and 108 may have any geometric or non-geometric shape. Although FIG. 1 illustrates three holes 106 and three holes 108, it should be noted that any number of holes may be provided.

In one embodiment, the tray 150 may include support members 110 and 112. The support members 110 and 112 may be located along a perimeter of the tray 150 to provide support against an outer packaging that the tray 150 is inserted into. Although the support members 110 and 112 are illustrated as being along a right perimeter and a left perimeter, respectively, the support members 110 and 112 may also be located along a top perimeter and a bottom perimeter. Although two support members 110 and 112 are illustrated in FIG. 1, it should be noted that any number of support members 110 and 112 (e.g., more or less) may be deployed. The support members 110 and 112 may prevent the outer packaging from getting crushed onto the false eyelashes 102 and 104 to prevent the false eyelashes 102 and 104 from getting damaged.

FIG. 1 illustrates the support members 110 and 112 as having a trapezoidal shape. However, it should be noted that the support members 110 and 112 may have any shape to provide sufficient protection against the outer packaging from crushing the false eyelashes 102 and 104.

Figure 3:
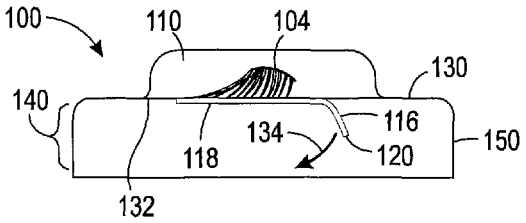
FIG. 3 depicts a side view of an example of a first embodiment of a false eyelash packaging.

In one embodiment, the support members 110 and 112 may have a height that is taller than a height of the false eyelashes 102 and 104. In one embodiment, the support members 110 and 112 may have a height that is sufficient to prevent a bowing effect of an outer packaging from touching the false eyelashes 102 and 104. FIG. 3 illustrates a side view of the first embodiment of the false eyelash packaging 100 and illustrates the height of the support member 110 relative to the false eyelash 104.

Figure 2:
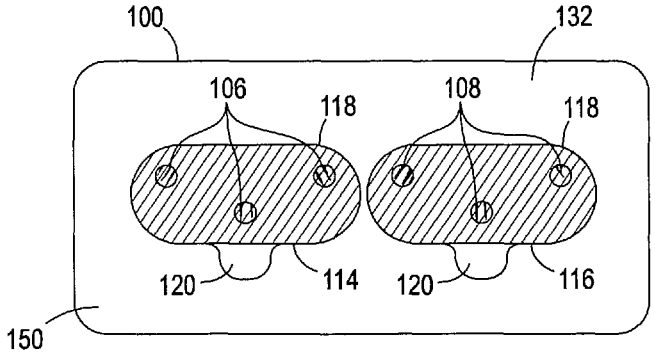
FIG. 2 depicts a bottom view of an example of a first embodiment of a false eyelash packaging.

FIG. 2 illustrates a bottom view of the first embodiment of the false eyelash packaging 100. In one embodiment, a bottom side 132 of the false eyelash packaging 100 may include adhesive tabs 114 and 116. In one embodiment, the adhesive tab 114 may be associated with the one or more holes 106 and the false eyelash 102. In one embodiment, the adhesive tab 116 may be associated with the one or more holes 108 and associated with the false eyelash 104.

In one embodiment, the adhesive tabs 114 and 116 may include an adhesive side 118 and a non-adhesive member 120. In one embodiment, the adhesive side 118 may be stuck to the bottom side 132. The one or more holes 106 and 108 may allow a small amount of the adhesive side 118 to be exposed to the false eyelashes 102 and 104. As a result, the false eyelashes 102 and 104 may be secured to the top side 130 of the tray 150 via the adhesive side 118 in contact with the bottom side 132 of the tray 150.

In one embodiment, the adhesive tabs 114 and 116 may have a width that is approximately a width of the false eyelashes 102 and 104. In one embodiment, the adhesive tabs 114 and 116 may have a width that is wide enough to cover the one or more holes 106 or the one or more holes 108, respectively.

In one embodiment, the adhesive tabs 114 and 116 may have a generally oval shape. In another embodiment, the adhesive tab may have any geometric shape (e.g., a rectangle, square, circle, and the like) or any non-geometric shape (e.g., an irregular shape).

In one embodiment, the non-adhesive member 120 may be free from any adhesive to allow the non-adhesive member 120 to hang freely. FIG. 3 illustrates a side view of the first embodiment of the false eyelash packaging 100. As illustrated in FIG. 3, the non-adhesive member 120 may hang away from the bottom side 130 of the tray 150. As a result, a user may pull the non-adhesive member 120 downward in a direction illustrated by an arrow 134 to remove the adhesive side 118 from the bottom side 130 of the tray 150. The user may have the top side 130 of the tray 150 facing him or her as the non-adhesive member 120 is pulled downward.

As a result, the false eyelashes 102 and 104 may rest on the top side 130 of the tray 150 as the adhesive tabs 114 and 116 are removed without the user having to handle or touch the false eyelashes 102 and 104. In other words, the false eyelashes 102 and 104 may be removed without being handled or touched by the user. As a result, the potential for damaging the false eyelashes 102 and 104 during removal from the false eyelash packaging 100 is minimized.

In one embodiment, the non-adhesive member 120 may have a generally narrow shape that has a length that is greater than a width. In one embodiment, the non-adhesive member 120 may be located along a center of a length of the adhesive tabs 114 and 116. The location of the non-adhesive member 120 may provide leverage to allow the entire adhesive tabs 114 and 116 to be removed without tearing off of the adhesive side 118. In other words, by locating the non-adhesive member 120 along a center and a length of the adhesive tabs 114 and 116, pulling the non-adhesive member 120 may allow an even and smooth removal of the adhesive side 118 from the bottom side 132 of the tray 150 without tearing.

In one embodiment, the non-adhesive member 120 and the adhesive side 118 may be molded from a single piece of plastic and be a single unitary piece to form the adhesive tab 114 and 116. The adhesive may be added to the adhesive side 118 after the adhesive tab 114 and 116 are formed.

In one embodiment, the tray 150 may also have a height dimension 140 as illustrated in FIG. 3. The structure and design of the tray 150 may allow the tray 150 to bear the weight of other false eyelash packaging 100 when they are stacked on top of one another to prevent the tray 150 from bending and causing damage to the false eyelashes 102 and 104 during shipping and display.

Figure 4:
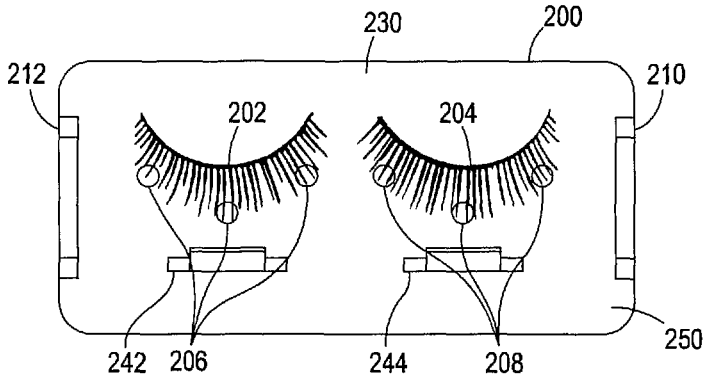
FIG. 4 depicts a top view of an example of a second embodiment of a false eyelash packaging.
Figure 5:
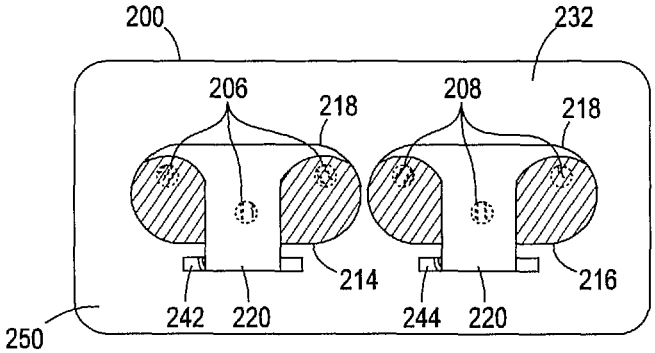
FIG. 5 depicts a bottom view of an example of a second embodiment of a false eyelash packaging.
Figure 6:
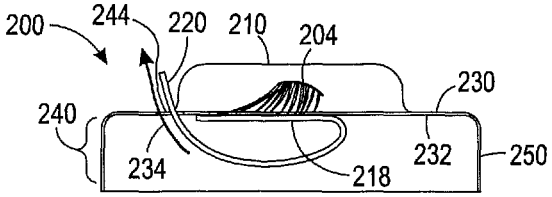
FIG. 6 depicts a side view of an example of a second embodiment of a false eyelash packaging.

FIGS. 4-6 illustrate a top view, a bottom view and a side view, respectively, of a second embodiment of a false eyelash packaging 200. The false eyelash packaging 200 may be similar to the false eyelash packaging 100 in all respects except a few differences. The differences may include the way adhesive tabs 214 and 216 are coupled to a bottom side 232 of a tray 250 and an inclusion of slotted openings 242 and 244 in the tray 250 that are associated with the false eyelashes 202 and 204, respectively, and the adhesive tabs 214 and 216, respectively.

As illustrated in FIG. 4, the tray 250 includes the slotted openings 242 and the slotted openings 244. Although, the slotted openings 242 and 244 are illustrated as having a generally rectangular shape, it should be noted that the slotted openings 242 and 244 may have any shape that allows a non-adhesive member 220 to be passed through to a top side 230 of the tray 250.

The width of the slotted openings 242 and 244 may be wide enough to allow the non-adhesive member 220 to pass through, but narrow enough to prevent the adhesive side 218 from passing through. As a result, the adhesive side 218 may remain isolated from the false eyelashes 202 and 204 on the top side 230 of the tray 250. Otherwise, if the slotted openings 242 and 244 were wide enough to allow the adhesive side 218 to pass through, the adhesive side 218 may accidentally attach to the false eyelashes 202 and 204, which could lead to damaging the false eyelashes 202 and 204.

As illustrated in FIG. 5, the adhesive tabs 214 and 216 are coupled to the bottom side 232 of the tray 250 and looped around to allow the non-adhesive member 220 of the adhesive tabs 214 and 216 to be passed through the slotted openings 242 and 244, respectively, from the bottom side 232 to the top side 230 of the tray 250. In other words, an adhesive side 218 of the adhesive tabs 214 and 216 are coupled to the bottom side 232 of the tray 250. The non-adhesive member 220 is then looped or wrapped around and back over the adhesive side 218 and through the slotted openings 242 and 244 as shown in FIG. 5.

FIG. 6 illustrates in further detail how the non-adhesive member 220 is fitted through the slotted opening 244 from the bottom side 232 to the top side 230 of the tray 250. In one embodiment, the non-adhesive member 220 may be different from the non-adhesive member 120 in that the non-adhesive member 220 may have a longer length. For example, the length of the non-adhesive member 220 may be long enough to allow the non-adhesive member 220 be looped back and over the adhesive side 218 and through the slotted openings 242 and 244, as described above.

In one embodiment, a user may hold the tray 250 such that the top side 230 of the tray is facing the user. The non-adhesive members 220 of the adhesive tabs 214 and 216 will be facing the user. As a result, the user does not need to look under the tray 250 or flip the tray 250 upside down to remove the adhesive tabs 214 and 216. Rather, the user may hold the tray 250 and pull the non-adhesive members 220 upward as shown by an arrow 234 in FIG. 6. As the non-adhesive member 220 is pulled upward toward the user, the adhesive side 218 will be pulled away from the bottom side 232 of the tray 250, thereby, releasing the false eyelashes 202 and 204.

The design of the false eyelash packaging 200 and the way the adhesive tabs 214 and 216 are coupled to the tray 250 may be counter-intuitive to conventional designs. Notably, the non-adhesive members 220 are pulled upward to pull the adhesive side 218 of the adhesive tabs 214 and 216 downward away from the bottom side 232 of the tray 250. As a result, the user may hold the tray upright without fear of the false eyelashes 202 and 204 falling off of the tray 250 as the adhesive tabs 214 and 216 are removed.

In one embodiment, the length of the non-adhesive member 220 may be long enough to remove the adhesive side 218 from the one or more holes 206 and 208, while allowing a portion of the adhesive side 218 to maintain contact with the bottom side 232 of the tray 250 when the adhesive side 218 is blocked by the slotted openings 242 and 244. In other words, as the non-adhesive member 220 is pulled upward the adhesive side 218 will not be completely removed from the bottom side 232 of the tray 250. Rather, the adhesive side 218 will be removed just enough to uncover the holes 206 and 208 and free the false eyelashes 202 and 204 on the top side 230 of the tray 250.

This novel design may prevent the tray from "popping" as the downward pull of the adhesive side 218 is released from the bottom side 232 of the tray 250, thus, causing a sudden upward motion of the tray 250. Preventing the "popping" may further ensure that the user does not need to hold or touch the false eyelashes 202 and 204 when removing the adhesive tabs 214 and 216. In addition, the user may feel comfortable pulling the non-adhesive member 220 upward at any speed or pace to remove the adhesive side 218 from the holes 206 and 208 without worrying about the "popping" effect.

In one embodiment, the non-adhesive member 220 may be located along a center of a length of the adhesive side 218 to ensure that adhesive tabs 214 and 216 are not partially torn during removal. In one embodiment, the non-adhesive member 220 may be slightly tapered towards a base of the non-adhesive member 220 that is formed next to the adhesive side 218 to ensure the entire adhesive tab 214 or 216 is removed as the non-adhesive member 220 is pulled upwards.

Notably, the user need not touch, handle, grasp or hold the false eyelashes 202 and 204 as the non-adhesive member 220 is being pulled upward. Advantageously, the false eyelashes 202 and 204 remain on the top side 230 of the tray 250 as the adhesive tabs 214 and 216 are removed from the bottom side 232 of the tray 250.

Thus, the embodiments of the false eyelash packaging 100 and 200 may be similar in that both allow the user to remove the false eyelashes without touching or handling the false eyelashes. Rather, the false eyelashes remain on a top side of the tray while the adhesive tabs are removed.

However, the false eyelash packaging 100 and 200 may differ in a direction the non-adhesive members of the adhesive tabs are pulled to remove the adhesive tabs from the bottom side of the tray. For example, the non-adhesive member 120 may be pulled in a downward direction in the false eyelash packaging 100 and the non-adhesive member 220 may be pulled in an upward direction through a slotted opening 242 or 244 in the false eyelash packaging 200.

Figure 7:
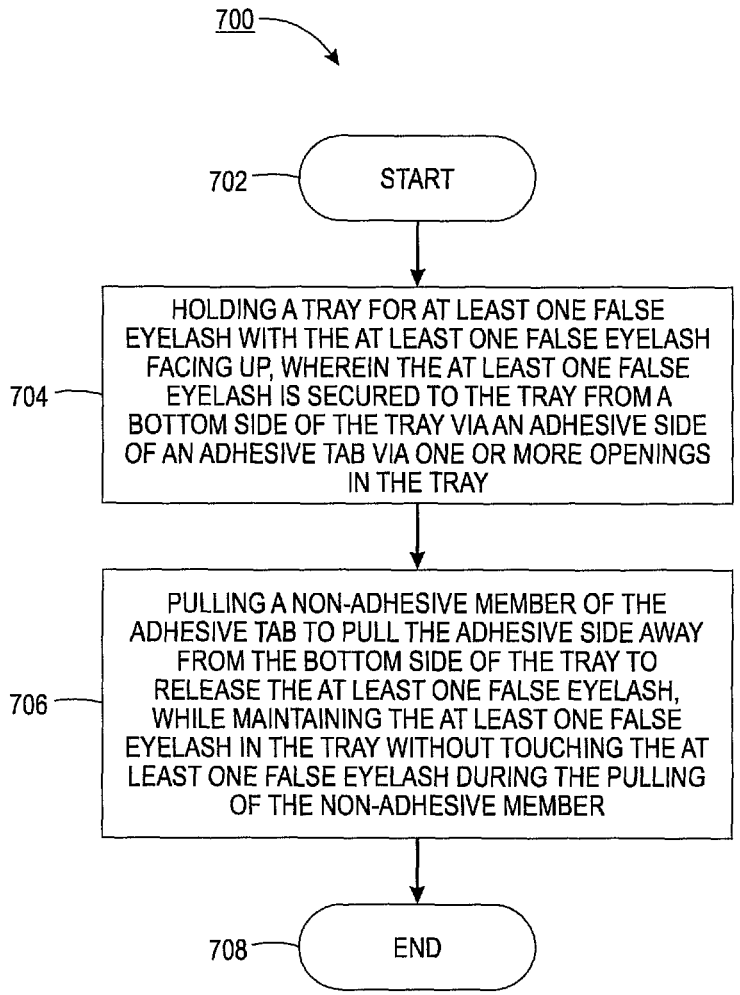
FIG. 7 depicts a flow chart of an example method for removing at least one false eyelash from a packaging.

FIG. 7 illustrates a flowchart of a method 700 for removing at least one false eyelash from a packaging in accordance with the present disclosure. The method 700 begins in step 702. At step 704, the method 700 holds a tray for at least one false eyelash with the at least one false eyelash facing up, wherein the at least one false eyelash is secured to the tray from a bottom side of the tray via an adhesive side of an adhesive tab via one or more openings in the tray.

At step 706, the method 700 pulls a non-adhesive member of the adhesive tab to pull the adhesive side away from the bottom side of the tray to release the at least one false eyelash, while maintaining the at least one false eyelash in the tray without touching the at least one false eyelash during the pulling of the non-adhesive member. In one embodiment, the non-adhesive member may be pulled downward away from the bottom side of the tray.

In another embodiment, the non-adhesive member may be pulled upward through a slotted opening in the tray to pull the adhesive side away from the bottom side of the tray. In one embodiment, the adhesive side of the adhesive tabs may not be completely removed from the bottoms side of the tray to prevent the tray from popping and launching the false eyelashes upwards. This may ensure that the user need not hold, touch or handle the false eyelashes while the adhesive tabs are removed. At step 708, the method 700 ends.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A packaging for at least one false eyelash, comprising:

a tray, the tray comprising:

one or more openings; and a slotted opening; and at least one adhesive tab comprising an adhesive side coupled to a bottom side of the tray, wherein the adhesive side sticks to the at least one false eyelash via the one or more openings in the tray, wherein the at least one adhesive tab comprises a non-adhesive member that is looped back and over the adhesive side on the bottom side of the tray fitted through the slotted opening to appear on a top side of the tray where the at least one false eyelash is located, wherein the non-adhesive member is pulled in an upward direction from the top side where the at least one false eyelash is located to pull the adhesive side away from the bottom side of the tray to allow releasing of the at least one false eyelash from the top side of the tray without a user touching the at least one false eyelash, wherein a width of the slotted opening is sized to allow the non-adhesive member to pass through the slotted opening and prevent the adhesive side from passing through the slotted opening.

2. The packaging of claim 1, wherein the tray further comprises:

one or more support members along a perimeter of the tray.

3. The packaging of claim 1, wherein the tray comprises a rectangular shape.

4. The packaging of claim 1, wherein the tray comprises a plastic.

5. The packaging of claim 1, wherein the one or more openings comprises a first set of one or more openings for a first one of the at least one false eyelash and a second set of one or more openings for a second one of the at least one false eyelash.

6. The packaging of claim 5, wherein the slotting opening comprises a first slotted opening for the first one of the at least one false eyelash and a second slotted opening for the second one of the at least one false eyelash.

7. The packaging of claim 6, wherein the at least one adhesive tab comprises a first adhesive tab for the first set of one or more openings and the first slotted opening for the first one of the at least one false eyelash and a second adhesive tab for the second set of one or more openings and the second slotted opening for the second one of the at least one false eyelash.

8. The packaging of claim 7, wherein a width of the first adhesive tab is at least as wide as a width of the first one of the at least one false eyelash and the second adhesive tab is at least as wide as a width of the second one of the at least one false eyelash.

9. A method for removing at least one false eyelash from a packaging, comprising:

holding a tray for the at least one false eyelash with the at least one false eyelash facing up, wherein the at least one false eyelash is secured to the tray from a bottom side of the tray via an adhesive side of an adhesive tab via one or more openings in the tray; and pulling a non-adhesive member of the adhesive tab that is looped back and over the adhesive side on the bottom side of the tray and fitted through a slotted opening on a top side of the tray where the at least one false eyelash is located, wherein the non-adhesive member is pulled in an upward direction from the top side where the at least one false eyelash is located to pull the adhesive side away from the bottom side of the tray to allow releasing of the at least one false eyelash from the top side of the tray without a user touching the at least one false eyelash, wherein a width of the slotted opening is sized to allow the non-adhesive member to pass through the slotted opening and prevent the adhesive side from passing through the slotted opening, while maintaining the at least one false eyelash in the tray without touching the at least one false eyelash during the pulling of the non-adhesive member.

* * * * *